US005731269A

United States Patent [19]

Clermont

[11] Patent Number: 5,731,269

[45] Date of Patent: Mar. 24, 1998

[54] MECHANICALLY ADJUSTABLE COUPLING LOOP FOR A RESONATOR

[75] Inventor: Craig Robert Clermont, Round Lake Beach, Ill.

[73] Assignee: Illinois Superconductor Corporation, Mt. Prospect, Ill.

[21] Appl. No.: 558,009

[22] Filed: Nov. 13, 1995

[51] Int. Cl.[6] ..... H01P 5/04; H01P 7/06; H01B 12/02

[52] U.S. Cl. ..... 505/210; 505/700; 505/866; 333/230; 333/24 R; 333/99 S

[58] Field of Search ..... 333/230, 24 R, 333/995; 505/210, 700, 861

[56] References Cited

U.S. PATENT DOCUMENTS

| | | | |
|---|---|---|---|
| 2,524,532 | 10/1950 | Linder | 333/230 X |
| 3,657,671 | 4/1972 | Masters et al. . | |
| 4,028,652 | 6/1977 | Wakino et al. | 333/73 W |
| 4,051,447 | 9/1977 | Heckman, Jr. | 333/24 R |
| 4,184,123 | 1/1980 | Grill et al. | 330/56 |
| 4,206,428 | 6/1980 | Kaegebein | 333/207 |
| 4,241,322 | 12/1980 | Johnson et al. | 333/202 |
| 4,446,429 | 5/1984 | Froncisz et al. | 324/316 |
| 4,551,694 | 11/1985 | Biehl et al. | 333/24 |
| 4,725,779 | 2/1988 | Hyde et al. | 324/318 |
| 4,896,125 | 1/1990 | Blair, Jr. et al. | 333/219.1 |
| 5,051,714 | 9/1991 | Bentivenga et al. | 333/227 |
| 5,319,313 | 6/1994 | Vogel et al. | 333/230 X |
| 5,340,797 | 8/1994 | Hodge et al. | 505/742 |

FOREIGN PATENT DOCUMENTS

| | | | |
|---|---|---|---|
| 574218 | 4/1959 | Canada | 333/230 |
| 1 010 595 | 6/1957 | Germany . | |
| 1 029 435 | 3/1958 | Germany . | |
| 1068323 | 11/1959 | Germany | 333/24 R |

OTHER PUBLICATIONS

Hardy and Whitehead, "Split–ring resonator for use in magnetic resonance from 200–2000 MHz," *Rev. Sci. Instrum.*, 52(2) (Feb. 1981) pp. 213–216.

Delayen, Dick and Mercereau, "Test of a $\beta = 0.1$ Superconducting Split Ring Resonator*," *IEEE Transactions on Magnetics*, vol. Mag–17, No. 1, (Jan. 1981) pp. 939–942.

Bell, Jr., "Narrow Bandstop Filters," *IEEE Transactions on Microwave Theory and Techniques*, vol. 39, No. 12, (Dec. 1991) pp. 2188–2191.

Bell, Jr., "Canonical Asymmetric Coupled–Resonator Filters," *IEEE Transactions on Microwave Theory and Techniques*, vol. MTT–30, No. 9 (Sep. 1982) pp. 1335–1340.

Bell, Jr., "Transformed–Variable Synthesis of Narrow–Bandpass Filter," *IEEE Transactions on Circuits and Systems*, vol. CAS–26, No. 6 (Jun. 1979) pp. 389–394.

Bell, Jr., "Bandwidth Adjustment in Iterative Approximation Procedures," *IEEE Transactions on Circuits and Systems*, vol. CAS–25, No. 12 (Dec. 1978) pp. 951–954.

Jezek, Tran and Ishii, "Strip–ring resonator makes harmonics–rich oscillator," *Microwaves & RF* (Jun. 1984) pp. 132–134.

*Primary Examiner*—Benny T. Lee

*Attorney, Agent, or Firm*—Marshall, O'Toole, Gerstein, Murray & Borun

[57] ABSTRACT

An adjustable coupler for coupling electromagnetic energy into or out of a resonant cavity has an input/output line connected to a loop or conductor. A base of the coupler has a passageway into which a bolt is inserted. Threads on a bolt engage threads on a nut attached to the conductor. A head of the bolt is held in place on the outside of the base so that rotation of the head moves the nut and conductor.

14 Claims, 2 Drawing Sheets

1 / 2

MECHANICALLY ADJUSTABLE COUPLING LOOP FOR A RESONATOR

The present invention relates generally to devices for coupling signals to or from a resonant cavity or resonator and more particularly to a coupler where its position relative to the cavity or resonator can be adjusted and then held securely in place.

BACKGROUND ART

Resonant cavities or resonators contained in cavities are commonly used in electromagnetic filters to eliminate unwanted frequencies from an input signal. The cavities generally contain a resonator made of a conductor, a superconductor and/or a dielectric. Most filter designs require coupling the input signal into a filter cavity and then coupling it out, possibly after passing through a number of other resonant cavities. The most common method of coupling is to pass a loop of wire through the cavity wall into the cavity. One end of the loop is connected to the input signal source and the other end may be connected to ground, such as a filter housing, so that a magnetic field is created.

In order to insure proper coupling, the coupling loop must be precisely positioned in the cavity and/or adjacent a resonator. Due to minor variations in resonators and resonant cavities, it is usually not possible to correctly position the coupling loop until the resonator and cavity have been completely assembled and tested. Openings are sometimes drilled through cavity walls so that a tool can be inserted into the cavity to manipulate the coupling loop. Such a procedure has two major drawbacks. First, the loop must be pliable enough to be easily moved by the tool and so may be subject to dislocation after positioning, particularly during shipment of the filter. The second drawback is that the opening in the cavity wall may have detrimental electromagnetic effects or may be impractical in filters using a superconducting resonator. Superconductors often require a controlled environment, such as being surrounded by an inert gas, like helium, or subject to vacuum in order to operate at peak efficiency, prohibiting the use of any design requiring an opening in a cavity wall.

Couplers have been designed which use a screw passing through a cavity wall to force the loop in one direction away from the wall. That design is disadvantageous because it only permits one type of movement of the loop; the loop cannot be readjusted if it has been pushed too far from the cavity wall during tuning. Moreover, the loop is not held firmly in place since the screw can only prevent movement in one direction.

SUMMARY OF THE INVENTION

In accordance with one aspect of the present invention, an adjustable coupler for coupling electromagnetic energy to or from a resonator has a base with a first side adjacent to the resonator and a second side. The coupler has an input/output line and a conductor having a first part made of a deformable material and having a second part electrically connected to the input/output line. A brace is located between the first side of the base and the first part of the conductor. An adjuster on the second side of the base moves the brace to increase or decrease the distance between the first side of the base and the first part of the conductor.

There may be a third part on the conductor where the second part and the third part of a conductor are fixed with respect to the base. The third part of the conductor may be connected to ground.

There may be a threaded opening on the first part of the conductor and threads on the brace. Rotation of the adjustor rotates the brace so that the threads of the brace engage the threads of the first part of the conductor to move the first part of the conductor away from or closer to the base. There may be a passageway through the base from the first side of the base to the second side of the base. The brace passes through the passageway and the passageway has a diameter. A head on the brace has a diameter larger than the diameter of the passageway.

A plate may be attached to the second side of the base. A bore having a diameter passes through the plate and the head of the brace is between the base and the plate. The diameter of the bore in the plate is smaller than the diameter of the head in the brace and the head of the brace can be rotated through the bore. The brace may be an electrical insulator.

The coupler may be used in combination with a housing having a housing wall defining a cavity. A resonator is located in the cavity adjacent the conductor. The conductor and first side of the base are inside the cavity and the second side of the base is outside the cavity. The wall and the base may be separate structures and the wall may have an opening for insertion of the base. The wall and the base may be electrically connected and the resonator may be a superconductor.

In accordance with another aspect of the present invention, an adjustable coupler for coupling electromagnetic energy to or from a resonator has a base with a first side adjacent to the resonator and a second side. An input/output line is electrically connected to a conductor which has a first part made of a deformable material. The base has a passageway with a diameter. A bolt with threads has a head with a diameter where the bolt is inserted into the passageway of the base. A plate is provided having a bore with a diameter. The diameter of the head is larger than the diameter of the passageway, the diameter of the head is larger than the diameter of the bore, and the head is between the plate and the base. The threads on the brace engage the first part of the conductor and rotation of the head of the bolt moves the first part of the conductor.

Other features and advantages are inherent in the adjustable coupler claimed and disclosed or will be apparent to those skilled in the art from the following detailed description in conjunction with the accompanying drawing.

DETAILED DESCRIPTION OF THE PREFERRED EMBODIMENT

Figure 1:
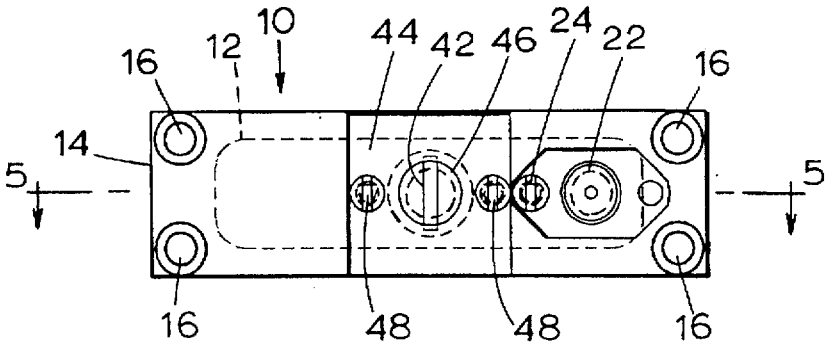
FIG. 1 is a top-plan view of a coupler of the present invention.
Figure 2:
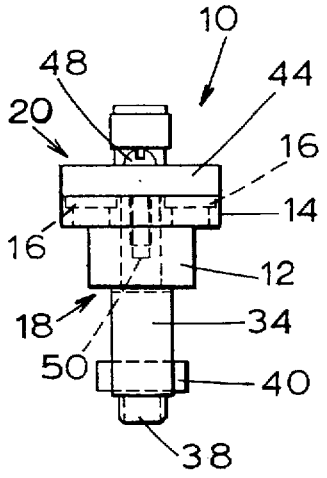
FIG. 2 is an end-elevational view of the coupler of FIG. 1.
Figure 3:
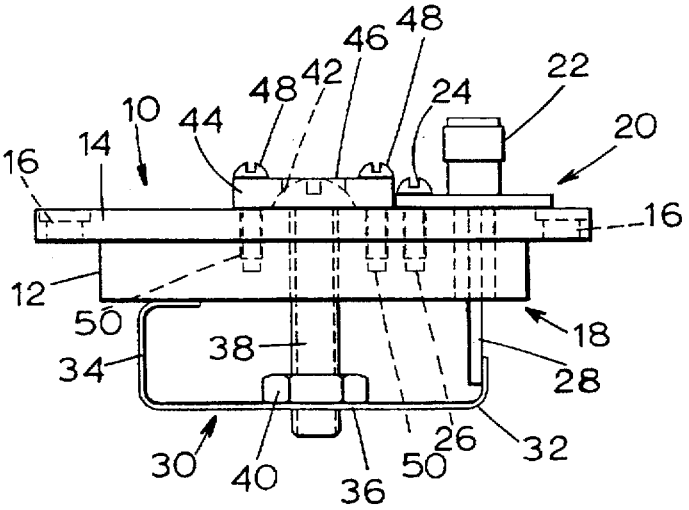
FIG. 3 is a side-elevational view of the coupler of FIG. 1.

Referring initially to FIGS. 1–4, a coupler 10 has a base 12 including a rim 14. The base 12 and rim 14 may be formed integrally or could be made from separate pieces welded together. Four bores 16 pass through the rim 14 and are used to connect the coupler 10 to another structure such as a cavity wall. The coupler 10 has a bottom side 18 (FIGS. 2 and 3) and a top side 20 (FIGS. 2 and 3). On the top side 20 is an electrical connector 22 (FIGS. 1, 3, and 4) attached to the coupler 10 with a screw 24 (FIGS. 1 and 3) inserted into a threaded opening 26 (FIG. 3). The connector 22 has an input/output line 28 (FIG. 3) which passes through and is insulated from the base 12. The connector 22 is of a conventional coaxial type and is used to connect the coupler either to a signal source or to a device which will use a filtered signal passing out of the coupler.

Figure 4:
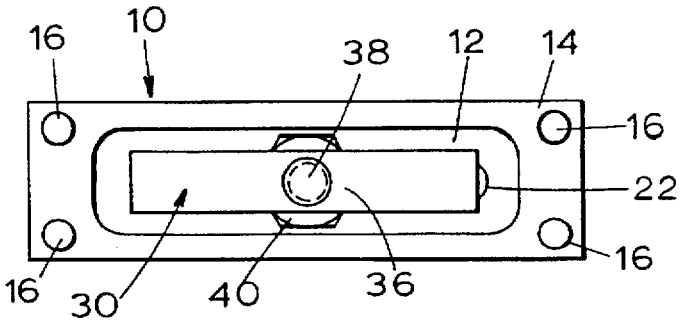
FIG. 4 is a bottom-plan view of the coupler of FIG. 1.

Attached to the input line 28 by welding or soldering is a loop or conductor 30 (FIGS. 3 and 4). The conductor 30 has an end 32 (FIG. 3) and an end 34 (FIGS. 2 and 3). By being connected to the input/output line 28, the end 32 of the conductor 30 is fixed with respect to the bottom side 18 of the base 12. The end 34 of the conductor 30 is attached to the bottom side 18 of the base 12 in a fixed position. The conductor 30 has a middle section 36 (FIGS. 3 and 4) having an opening through which a bolt 38 (FIGS. 2, 3, and 4) passes. Attached to the middle section 36 of the conductor 30 is a nut 40 (FIGS. 2, 3, and 4) which has a threaded interior to accept the threaded exterior of the bolt 38. The nut 40 is welded or soldered to the middle section 36 so that they move together. Instead of using the nut 40, it is possible to place a threaded opening directly in the middle section 36.

The bolt 38 passes through the base 12 and can be rotated with respect to the base. The bolt 38 has a head 42 (FIGS. 1 and 3) which is held in place on the top side 20 of the base 12 by a plate 44. The plate 44 has a bore 46 (FIGS. 1 and 3) through it which permits access to the bolthead 42 so that a screwdriver can be inserted into the bore 46 to rotate the bolt 38 (FIGS. 1 and 3). The plate 44 is held to the base 12 by screws 48 (FIGS. 1 and 3) inserted into threaded openings 50 (FIGS. 2 and 3). The plate 44 and the bore 46 are shaped to conform with shape of the bolthead 42 to prevent gas from passing between the bolthead 42 and the plate 44 (see FIGS. 1, 2, and 3).

When the head 42 of the bolt 38 is rotated, the threads of the bolt 38 engage the nut 40. The head 42 is held in place by the top 20 of the base 12 and the plate 44 so that the bolt cannot move (except for rotation) with respect to the base 12. When the bolt 38 is rotated, the nut 40 and middle section 36 of the conductor 30 will be pushed away from or pulled closer to the bottom 18 of the base 12. The middle section 36 of the conductor 30 must therefore be made of a deformable material, such as a copper strip about 0.020 inches (0.051 cm) thick by about 0.250 inches (0.635 cm) wide.

Figure 5:
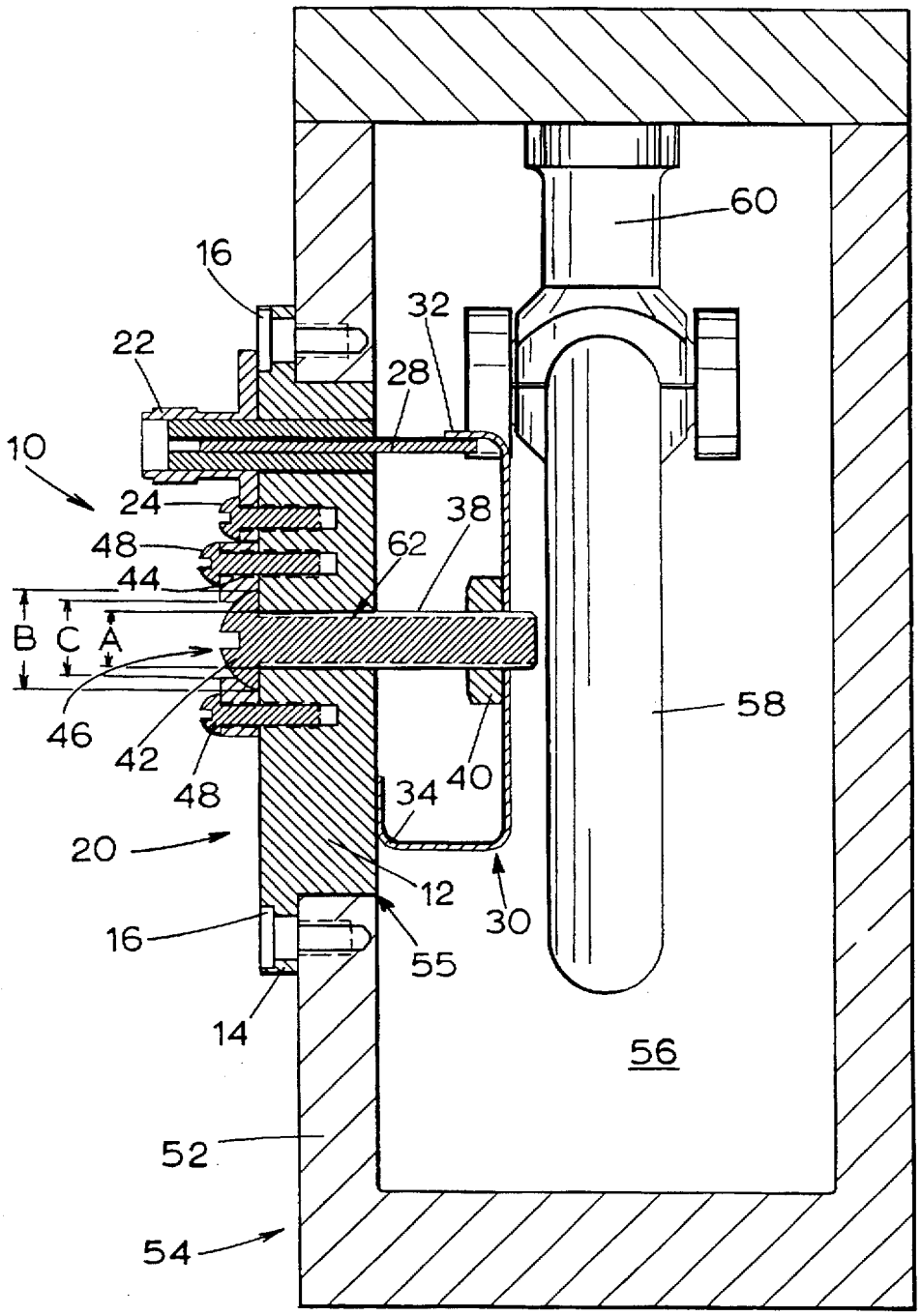
FIG. 5 is a sectional view of the coupler taken along the line 5—5 of FIG. 1, placed into a resonant cavity.

FIG. 5 shows the coupler 10 attached to a wall 52 of a filter housing 54. The elements in FIG. 5 corresponding to elements in FIGS. 1–4 are provided with the same numerals as those corresponding elements. The rim 14 is placed against the outside of the wall 52, and the base 12 is inserted into an opening 55 in the wall 52. The housing 54 defines a cavity 56 which contains a resonator 58. The resonator is attached to the housing 54 by a mounting stand 60. All variety of resonators can be used, including conductors, superconductors and dielectric. If a superconducting resonator is used and it is desirable to seal the cavity 56, the coupler 10 will permit adjustment of the conductor 30 with the cavity sealed.

FIG. 5 also more clearly shows the operation of the bolt 38. A passageway 62 in the base 12 has a diameter A. The diameter A is smaller than a diameter B of the bolthead 42. The diameter B of the bolthead 42 is also larger than the diameter C of the bore 46 in the plate 44. The head 42 and the rest of the bolt 38 can rotate with respect to the base 12, but cannot move in or out of the passageway 62. The plate will also serve to provide a seal between the head 42 and the top side 20 of the base 12 so that gases cannot pass into or out of the cavity 56 through the passageway 62. The immobility of the head (except for rotation) 42 not only allows the bolt 38 to move the conductor 30, but also allows the bolt 38 to serve as a brace so that the conductor 30 will be held in place after it has been adjusted or tuned for proper coupling.

The bolt 38 may be made of a electrically non-conductive material such as nylon. The base 12 may be made of a metal such as copper. The walls of the housing 54 can be made of any rigid material, but will usually be made of a metal such as copper or aluminum possibly coated with silver. In many instances it is desirable for the end 34 of the conductor 30 to be connected to ground, so the base 12 and wall 52 will normally be made of a conductor. It is also possible to use a bolt containing an electric conductor and have the bolt pass through an opening in the end of the coupling loop which is not attached to the base. In such a design the bolt will move and secure the loop and will also serve as ground for the loop.

Rather than making the wall 52 and the base 12 out of separate components, it is possible to place the bolt 38 directly through a housing wall so that the housing wall serves as the base. If the coupler 10 is used in a superconducting environment, indium solder or wire may be placed between the coupler 10 and the wall 52 and also between the top side 20 of the base 12 and the plate 44 and the connector 22.

The foregoing detailed description has been given for clearness of understanding only and no unnecessary limitations should be understood therefrom as modifications would be obvious to those skilled in the art.

I claim:

1. An adjustable coupler for coupling electromagnetic energy to or from a resonator comprising:

a base having a first side adjacent to the resonator and a second side;

an input/output line;

a conductor comprising a first part comprised of a deformable material and having a second part electrically connected to the input/output line;

a brace attached between the first side of the base and the first part of the conductor;

a threaded opening on the first part of the conductor;

threads on the brace;

a distance between the first side of the base and the first part of the conductor; and an adjuster on the second side of the base;

wherein rotation of the adjuster rotates the brace and wherein the threads of the brace engage the threads of the first part of the conductor to move the first part of the conductor away from or closer to the base.

2. A resonant structure including an adjustable coupler for coupling electromagnetic energy to or from a resonator, the adjustable coupler comprising:

a base having a first side adjacent to the resonator and a second side;

an input/output line;

a conductor comprising a first part comprised of a deformable material and having a second part electrically connected to the input/output line;

a brace attached between the first side of the base and the first part of the conductor;

a third part on the conductor attached to the first part wherein the second part and the third part of the conductor are fixed with respect to the base;

a distance between the first side of the base and the first part of the conductor; and an adjuster on the second side of the base;

wherein the adjuster is mechanically coupled to the brace thereby causing the brace to increase or decrease the distance between the first side of the base and the first part of the conductor while the brace remains fixedly attached to the first part of the conductor.

3. The resonant structure of claim 2 wherein the brace comprises an electrical insulator.

4. The resonant structure of claim 2 comprising:

a threaded opening on the first part of the conductor; and threads on the brace;

wherein rotation of the adjuster rotates the brace and wherein the threads of the brace engage the threads of the first part of the conductor to move the first part of the conductor away from or closer to the base.

5. The resonant structure of claim 4 comprising:

a passageway through the base from the first side of the base to the second side of the base wherein the brace passes through the passageway and the passageway has a cross-section; and a head on the brace having a cross-section larger than the cross-section of the passageway.

6. The resonant structure of claim 5 comprising:

a plate attached to the second side of the base; and a bore, having a cross-section, passing through the plate;

wherein the head of the brace is between the base and the plate, the cross-section of the bore in the plate is smaller than the cross-section of the head of the brace and the head of the brace can be rotated via access through the bore.

7. The resonant structure of claim 2 comprising:

a housing having a housing wall defining a cavity; wherein the resonator is located inside the cavity adjacent the conductor; and wherein the conductor and first side of the base are inside the cavity and the second side of the base is outside the cavity.

8. The resonant structure of claim 7 wherein the resonator comprises a superconductor.

9. The resonant structure of claim 7 wherein:

the wall and the base are separate structures;

the wall has an opening; and the base is received within the opening.

10. The resonant structure of claim 7 wherein the wall and the base are electrically connected.

11. A resonant structure including an adjustable coupler for coupling electromagnetic energy to or from a resonator comprising:

a base having a first side adjacent to the resonator and a second side;

an input/output line;

a conductor comprising a first part comprised of a deformable material and having a second part electrically connected to the input/output line;

a passageway, having a cross-section, through the base;

a bolt with threads, having a head with a cross-section, received within the passageway of the base; and a plate, having a bore with a cross-section;

wherein the cross-section of the head is larger than the cross-section of the passageway, the cross-section of the head is larger than the cross-section of the bore and the head is between the plate and the base; and the threads on the bolt engage the first part of the conductor and rotation of the head of the bolt moves the first part of the conductor.

12. The resonant structure of claim 11 in combination with:

a housing having a housing wall defining a cavity; wherein the resonator located inside the cavity adjacent the conductor; and wherein the conductor and first side of the base are inside the cavity and the second side of the base is outside the cavity.

13. The resonant structure of claim 11 comprising:

a third part on the conductor attached to the first part;

wherein the second part and the third part of the conductor are fixed with respect to the base and the third part of the conductor is connected to ground.

14. The resonant structure of claim 11 wherein the bolt comprises an electrical insulator.

* * * * *